United States Patent [19]

Funaki

[11] 4,040,160

[45] Aug. 9, 1977

[54] METHOD OF MANUFACTURING SYMBOL INDICATION DRUM

[75] Inventor: Takashi Funaki, Nagano, Japan

[73] Assignee: Kabushiki Kaisha Sankyo Seiki Seisakusho, Japan

[21] Appl. No.: 707,505

[22] Filed: July 22, 1976

Related U.S. Application Data

[60] Division of Ser. No. 585,772, June 11, 1975, which is a continuation of Ser. No. 410,336, Oct. 29, 1973, abandoned.

[30] Foreign Application Priority Data

Nov. 4, 1972 Japan ..... 47-127312[U]

[51] Int. Cl.[2] ..... B21D 53/26; B21K 1/28; B21K 1/42

[52] U.S. Cl. ..... 29/159 R; 29/148.4 D; 29/407; 29/464; 235/1 C

[58] Field of Search ..... 29/407, 148.4 D, 464, 29/159 R; 235/1 C; 116/114 R; 101/36, 38, 181, 368, 426, 401.2

[56] References Cited

U.S. PATENT DOCUMENTS

| | | | |
|---|---|---|---|
| 1,100,089 | 6/1914 | Ocumpaugh | 101/401.2 |
| 1,695,663 | 12/1928 | Rodanet | 235/1 C |
| 2,720,681 | 10/1955 | Danielson et al. | 235/1 C X |
| 3,254,600 | 6/1966 | Storm et al. | 101/401.2 |
| 3,380,149 | 4/1968 | Holbrook | 29/464 |
| 3,440,705 | 4/1969 | Johnson | 29/159 R |
| 3,441,998 | 5/1969 | Furst et al. | 29/159 R |
| 3,763,544 | 10/1973 | Gibson | 29/407 |

*Primary Examiner*—Charlie T. Moon
*Attorney, Agent, or Firm*—McGlew and Tuttle

[57] ABSTRACT

A drum formed on its outer peripheral surface with symbols and symbol position ascertaining marks. The symbols which, include characters, numerals, code marks and the like are superposed on the drum indirectly by affixing to the drum body a belt on which the symbols are positioned. For this purpose, the drum body is formed with a circumferentially aligned series of equalled spaced projections and the belt is formed with a longitudinally aligned series of perforations having a spacing equal to those of the projections. The drums can be used with any apparatus requiring symbol indication, e.g. time measuring instruments, gas meters, or calculators.

14 Claims, 11 Drawing Figures

METHOD OF MANUFACTURING SYMBOL INDICATION DRUM

CROSS-REFERENCE TO RELATED APPLICATION

This application is a division of application Ser. No. 585,772, filed on June 11, 1975 which, in turn, is a continuation of application Ser. No. 410,336, filed Oct. 29, 1973 and now abandoned.

BACKGROUND OF THE INVENTION

This invention relates to a symbol indication drum adapted for use with apparatus requiring symbol indication, e.g. time measuring instruments or computers.

Symbols may be provided on the outer peripheral surface of a symbol indication drum directly by superposing symbols thereon by printing or etching, or indirectly by affixing to a drum body a belt on which symbols are formed beforehand. In either cae, it is not possible to give accurate information by symbol indication unless the symbols are all disposed in predetermined positions with a high degree of precision.

When the symbols are superposed on the drum by printing, for example, it often happens that the master plate used slips and causes the symbols to be inordinately extended longitudinally or displaced transversely, with the result that the symbols are not correctly spaced apart from one another. When a symbol carrying belt is affixed to the drum body, expansion or contraction of the belt may be uneven throughout the length of the belt, thereby causing the symbols to be disposed at irregular intervals.

In testing whether or not the symbols are disposed in correct positions when a symbol carrying belt is affixed to a drum, there has hitherto been no alternative but to study the position of the outlines of each symbol. This has raised the problem of how to overcome the difficulty experienced in conducting the test.

SUMMARY OF THE INVENTION

This invention has as its object the provision of a symbol indication drum which has symbol position ascertaining marks provided on the outer peripheral surface of the drum so as to permit any variation in the position of each symbol on the outer periphery of the drum to be detected with ease.

The outstanding characteristic of the invention is that it is possible to test the degree of precision with which the symbols are positioned on the outer peripheral surface of the drum by using the symbol position ascertaining marks without studying the outlines of the symbols as has hitherto been the case. This makes it possible readily to detect drums which are unsatisfactory for specifications, thereby reducing cost.

In this invention, the symbols refer to characters, numerals, code marks and the like and the symbol position ascertaining marks refer to crosses (+), dot (·), perforations, or other marks.

DESCRIPTION OF EMBODIMENTS

Figure 1:
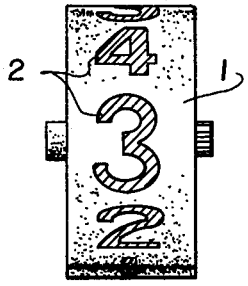
FIG. 1 is a front view of a symbol indication drum of the prior art.

A counter, digital timer, or the like comprises a drum having numerals printed or otherwise superposed on its outer peripheral surface and adapted to be rotated for indicating a counted value or the hours. The method of the prior art of testing the positions of the numerals printed or otherwise superposed on the outer peripheral surface of a drum will be first described with reference to the drawings. In FIG. 1, there is shown a drum 1 on whose outer peripheral surface numerals 2 are superposed at regular intervals by printing, which is the simplest and quickest method of superposing numerals on the drum.

Figure 3:
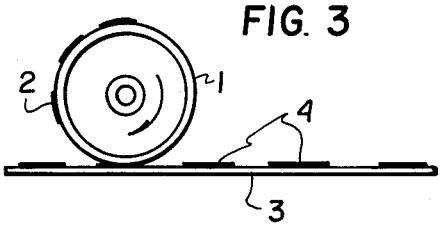
FIG. 3 is a side view of a drum and a master plate showing the manner in which symbols are printed on the outer periphery of the drum.

In FIG. 3, there is shown a master plate 3, in web form, on which mirror images 4, in ink, of numerals 0 to 9 are arranged at a constant pitch. In printing numerals on the outer peripheral surface of the drum 1, the master plate 3 is brought into contact with the outer peripheral surface of the drum 1 and the drum 1 is moved in rolling motion without slipping on master plate 3, so that the numerals 0 to 9 can be printed by transferring the mirror images 4, in ink, to the drum.

When the path of movement of the drum 1 deviates, even if slightly, from the longitudinal center axis of the master plate 3, as the drum is moved on the master plate, there is a discrepancy between the relative positions of the numeral printed first and the numeral printed last when the printing is finished. Also, when a slip occurs between drum 1 and master plate 3, the numeral printed at the time of the slip is extended circumferentially and becomes disfigured and the spacing between the circumferentially extended numeral and the next following numeral grows smaller than other spacings, no matter how small the slip is.

Figure 2:
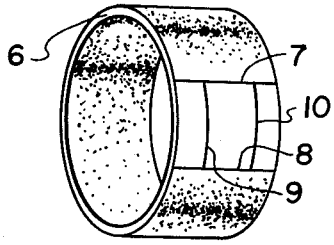
FIG. 2 is a perspective view of a tester of the prior art for ascertaining the positions of symbols on a symbol indication drum.

In order to obviate the aforementioned disadvantages of the method of printing numerals on the drum, it has hitherto been customary to use a tester 6 of annular shape shown in FIG. 2. The tester 6, which is made of a transparent material, is provided on its inner peripheral surface with a frame consisting of reference lines 7, 8, 9 and 10 which denotes the height and width of a numeral 2. The tester 6 has an inner diameter which is slightly larger than the outer diameter of the drum 1 so that the latter may be loosely fitted in the former. In testing whether or not the numerals 2 printed on the outer peripheral surface of the drum 1 are correctly positioned, the drum 1 is inserted in the tester 6 and rotated so as successively to bring one numeral after another into index with the frame defined by the reference lines 7, 8, 9 and 10. The operator checks whether or not each numeral 2 fits in the frame defined by the reference lines 7 to 10 by studying the height and width or outlines of the figure from outside.

In carrying out the aforementioned test, the width of a numeral 2 is tested and, while the right and left ends of the numeral are aligned with the vertical reference lines 9 and 10, the upper (or lower) end of the numeral is made to align with one of the transverse reference lines 7 and 8, and then the lower (or upper) end thereof is made to align with the other transverse reference line. This is a troublesome operation and an error is liable to be made. Thus it takes a long time to finish the testing of all the numerals on the drum.

In printing symbols on the drum 1 by transfer printing from the master plate 3, it is required to bring the drum into pressing engagement with the master plate with a suitable force. Thus, the numerals printed on the drum may be deformed by ink stains or shortage of ink or due to the quantity or the quality of ink supplied to the master plate or the finish of the outer peripheral surface of the drum.

Figure 5:
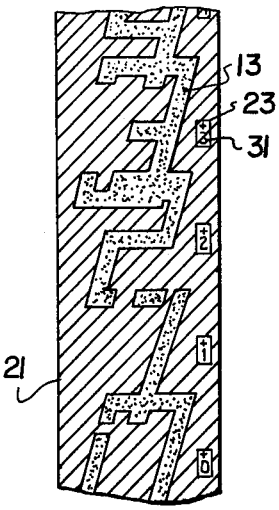
FIG. 5 is an enlarged developed view of the outer peripheral surface of another symbol indication drum embodying the invention.
Figure 6:
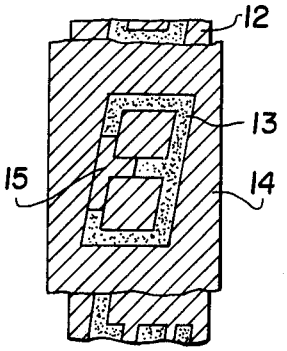
FIG. 6 is a schematic view showing the manner in which the symbol indication drum shown in FIG. 5 is put to use.

The numerals printed on the outer peripheral surface of the drum may be arranged by a method described below and shown in FIGS. 5 and 6. In FIG. 5 which shows, in a developed view, the outer peripheral surface of a drum 21 shown in FIG. 6, numerals 13 disposed on the outer peripheral surface of the drum 12 overlap the adjacent numerals and can be read by superposing, on the numerals 13, a mask plate 14 which is of the same color as the color of the background against which the numerals 13 are disposed. More specifically, the mask plate 14 is formed therein with a plurality of windows 15 (only one is shown in FIG. 6) formed by two parallel upright slits and three parallel horizontal slits extending from one upright slit to the other, with the vertical slits being slightly inclined to the vertical. When the mask plate 14 is placed on the outer peripheral surface of the drum 12, it is only those numerals 13 which can be seen through the windows 15 that can be read, with other numerals being covered by the windowless portion of the mask plate 14. The windowless portion of the mask plate 14 is of the same color as the background of the drum 12, so that the numerals 13 can be clearly recognized through the windows (the numeral 3 can be seen in FIG. 6).

The method of arranging the numerals such as shown in FIGS. 5 and 6 offers the advantage of permitting numerals of a large size to be printed and indicated in a relatively small space, because the pitch of the numerals printed by this method is one-half that of the numerals printed by the method shown in FIG. 1. However, the testing of the degree of precision with which the numerals 13 are arranged by the method shown in FIGS. 5 and 6 is far more troublesome than the testing of the degree of precision with which the numerals 2 are arranged by the method shown in FIG. 1, so that the method is very inefficient in operation.

Figure 4:
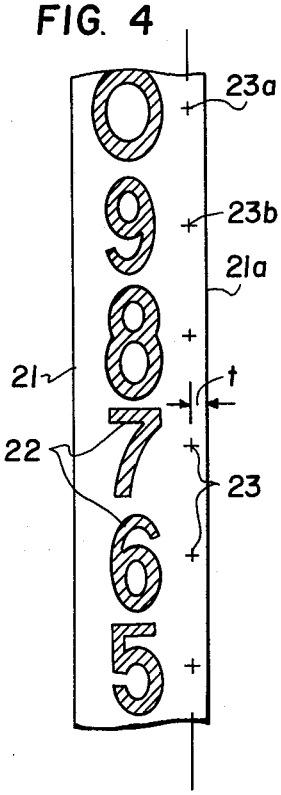
FIG. 4 is an enlarged developed view of the outer peripheral surface of a symbol indication drum embodying the invention.
Figure 7:
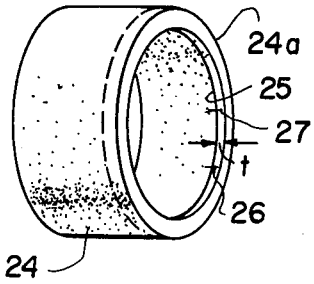
FIG 7 is a perspective view of the tester used for testing the positions of the symbols of the drums shown in FIGS. 4, 5 and 6

FIG. 4 shows, in a developed view, the outer peripheral surface of a drum 21 according to this invention. In the vicinity of each of numerals 22 printed on the drum, there is a reference mark 23 which is disposed in a portion of the outer peripheral surface of the drum 21 which is covered with the mask 14 (See FIG. 6) when the drum and other parts are assembled into an apparatus. The reference marks 23, which are printed at the same time as the numerals 22 are printed, are disposed at regular intervals or spaced apart from one another by a constant pitch. If the drum 21 rolls in a normal state longitudinally of the master plate 3 (See FIG. 3) when the numerals 22 are printed on its outer peripheral surface, all the reference points 23 will be spaced apart from an edge 21*a* of the periphery of the drum 21 by the same distance *t*. The testing of the degree of precision with which the numerals 22 are printed is effected by inserting the drum 21 in a tester 24 shown in FIG. 7. The tester 24, which is made of a transparent material, has formed, on its inner peripheral surface, a circumferentially oriented reference line 25, which is disposed at a distance *t* from an edge 24*a* of the tester 24. Two reference points 26 and 27 are formed on the reference line 25 in positions which are spaced apart from each other by one pitch of the numerals 22 on the drum 21.

By checking whether or not all the reference points 23 printed on the drum 21 are disposed on the reference line 25 on the tester 24 after the drum 21 is inserted in the tester 24 and their edges 21*a* and 24*a* are aligned with each other, it is possible to determine at once whether or not the numerals 22 are displaced transversely from their normal positions. Also, by bringing the reference point 23*a* of a numeral printed first, or 0, for example, into index with the reference point 26 on the tester 24 and by checking whether the reference point 23*b* for the numeral printed lastly, or 9, for example, is indexed with the reference point 27 on the tester 24, it is possible to determine whether or not the numerals 23 are displaced longitudinally from their normal positions. The result of this test gives a measure of the error committed in printing due to the slip of the drum on the master plate. Thus it will be seen that the degree of precision with which the numerals 22 are positioned transversely of the outer periphery of the drum can be determined by checking whether the reference line 23 on the drum 21 is brought into alignment with the reference line 25 on the tester 24, and that any displacement of the numerals 22 circumferentially from their normal positions can be found out at once by comparing the two reference points 26 and 27. It is not necessary to study the outlines of the numerals 22 in checking whether or not they are positioned correctly, as has been done in the prior art.

The method of relying on the reference points in testing the degree of precision with which the numerals 22 are printed on the drum 21 has particular utility when used with the drum 21 in which the numerals are arranged by the method as shown in FIG. 5. As shown, a reference point 13 is provided for each of the numerals 23 printed on the drum 21, with each reference point 23 being supplemented with a small figure 31 corresponding to the respective numeral 13 (the figure is 2 when the numeral 13 is 2, for example). The numerals 13 printed on the drum 21 overlap one another in parts as aforementioned. Thus difficulty is experienced in determining where one numeral ends and another numeral starts when the height and width of each numeral are measured by using the tester of the prior art shown in FIG. 2. However, by engaging the tester 24 over the drum 21, as the tester 24 is engaged over the drum 21 shown in FIG. 4, the degree of precision with which the numerals 23 are printed on the drum 21 shown in FIG.

5 can be readily determined in a short time interval. The reference points 23 printed on the drum 21 as shown in FIG. 5 are disposed in a position in which they are covered with mask 14, and the reference points 23 printed on the drum 21 as shown in FIG. 4 are disposed in positions in which they are covered with a mask (not shown) which parmits only the numerals 22 to be indicated.

Figure 8:
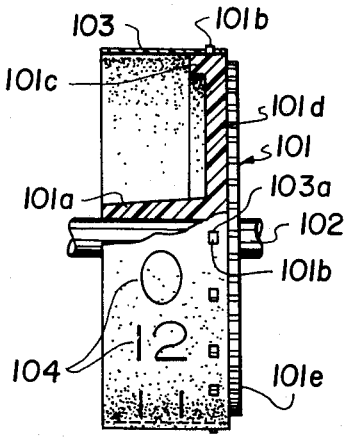
FIG. 8 is a front view, with certain parts being shown in section, of a symbol indication drum manufactured by the method of this invention.

The present invention is directed to symbol indication drums each having affixed to the drum body a belt on which symbols are printed. In FIG. 8, a drum body 101 comprises a tubular shaft portion 101*a* adapted to receive therein a support shaft 102 for supporting the drum body 101, a cylindrical support portion 101*c* of small width having teeth 101*b* arranged on its peripheral surface and serving as references when a bolt 103 is wound on the drum body, and a web portion 101*d* for interconnecting the tubular shaft portion 101*a* and the cylindrical support portion 101*b*. A serration or gear element 101*e* is disposed on the right side of the cylindrical support portion 101*c* for moving the drum in effecting tens transfer.

The various parts of the drum body 101 constructed as aforementioned may be made integrally of any synthetic resinous material which lends itself to molding, or may be made of metal by working metallic material. The drum body may be opaque and colorless or colored, or may be transparent and colorless or colored.

Figure 10:
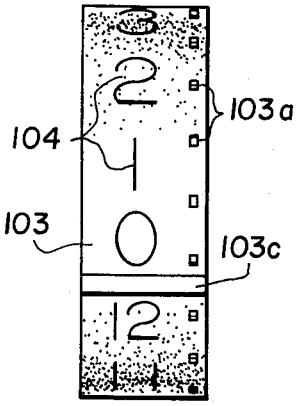
FIG. 10 and FIG. 11 are front views showing a symbol carrying belt affixed to a drum body, with the drum body not being shown.
Figure 11:
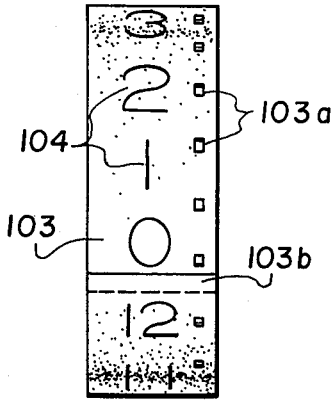

The belt 103 adapted to be wound on the drum body 101, which may be made of artificial leather, a film of a synthetic resinous material, e.g. a polyester, silicone, or acetate resin, or a thin sheet of metal, is formed at a side marginal portion thereof with perforations 103*a* arranged circumferentially of the belt 103, as shown in FIG. 10 or FIG. 11, and adapted to receive therein the teeth 101*b* on the drum body 101. The belt 103 has printed or otherwise superposed on its surface symbols 104, such as numerals, characters, or the like, which are used for displaying information. The numerals 104 are printed and the perforations 103*a* are formed by spreading the belt 103 before being wound on the drum body 101.

The superposing of the numerals 104 and the formation of the perforations 103*a* may be effected by known methods. The efficiency in operation can be greatly increased if the superposing of the numerals and the forming of the perforations are carried out continuously by using a belt of a large length. Since the belt is a film of a very small thickness, pinholes or other defects can be readily detected. The belt 103 may be opaque and colorless or colored, or may be transparent and colorless or colored. In superposing the numerals 104 on the belt 103, the numerals may be provided by photographic printing or by gluing to the belt a film on which the numerals 104 have been printed beforehand.

The belt 103, produced as aforementioned, is wound on the drum body 101 by successively inserting the teeth 101*b* on the drum body 101 into the perforations 103*a* in the belt 103. The forward end portion and the rear end portions of the belt 103 may be made not to overlap each other, as shown in FIG. 10, or may be made to overlap each other, as shown in FIG. 11. In either case, the belt 103 wound on the drum body 101 by using the teeth 101*b* as reference conforms to the shape of the cylindrical support portion 101*c*, so that a satisfactory symbol indication surface can be provided on the periphery of the drum body 101 even if the drum body is slightly deformed.

When the opposite end portions of the belt 103 are not made to overlap each other, as shown in FIG. 10, it is necessary that the marginal portion of the belt in which the perforations 103*a* are formed is made to adhere to the cylindrical support portion 101*c* of the drum body 101. However, when the opposite end portions are made to overlap each other, as shown in FIG. 11, it is necessary only to bond the opposite end portions of the belt to each other at the overlapping portion 103*b* to provide a satisfactory symbol indication surface for the symbol indication drum without requiring the bonding of the marginal portion of the belt to the drum body. However, the belt may be bonded to the drum body in any position as desired, even when the opposite end portions of the belt are made to overlap each other.

In bonding the belt to the drum body, the two may be adhesively bonded to each other by using an epoxy resin adhesive agent or other suitable adhesive agent, or may be bonded to each other by thermal fusion, high frequency adhesion, or spot welding.

Figure 9:
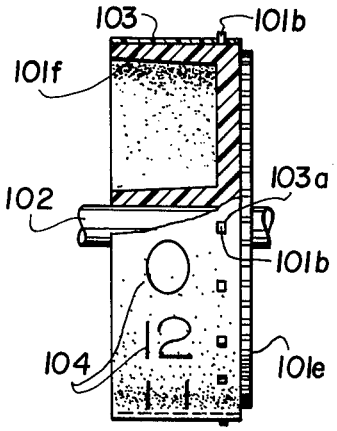
FIG. 9 is a front view, with certain parts being shown in section, of another symbol indication drum manufactured by the method of this invention.

In winding the belt 103 on the drum body 101, the drum body 101 used may be one in which the cylindrical support portion 101*f* has a large width as shown in FIG. 9. The use of the cylindrical portion 101*f* of a small width shown in FIG. 8 offers many advantages. It reduces the weight of the symbol indication drum and solves the problems posed by inertia and other phenomenons. When the symbol indication drum is of the internal illumination system, the drum has an improved light transmission because its thickness is small. When symbol indication is carried out by using a double layer system, in which the drum has two peripheral surfaces, the use of a small width cylindrical portion prevents the formation of an offset portion between the inner and outer layers because of the small thickness of the drum.

When a small width cylindrical portion is provided for the drum body, the edge of the belt 103 opposite to the marginal portion of the drum body 101 carrying the serration or gear element 101*e* may be used as a locking disk for the tens transfer feed wheel, or a serration may be formed therein for effecting tens transfer. Even if the opposite end portions of the belt do not overlap each other, as shown in FIG. 10, a gap 103*c* may be conveniently used as a portion of the serration.

In the invention, the teeth and the perforations may be in any number as desired and disposed on any positions as desired in the symbol indication drum. The perforations serve as symbol position ascertaining marks while the teeth serve as means for correctly positioning the symbols on the outer periphery of the symbol indication drum.

While specific embodiments of the invention have been shown and described in detail to illustrate the application of the principles of the invention, it will be understood that the invention may be embodied otherwise without departing from such principles.

I claim:

1. The method of manufacturing a rotatable symbol indication drum having indicia extending around its external periphery comprising the steps of forming a drum body including an axially elongated hub, an annular web extending radially from said hub, and a cylindrical rim extending axially from the outer end of said web concentric with said hub; preparing a relatively elongated indicia-carrying belt, having a length substantially equal to the external circumference of said cylindrical rim of said drum body, by providing a series of inked indicia thereon in correctly positioned longitudinal and lateral relation to each other and centered, laterally of said belt, at the same predetermined distance from a reference lateral edge of said belt; forming a series of perforations in said belt in adjacent spaced relation to said reference lateral edge at equal longitudinal spacings from each other and at equal lateral spacings from said reference lateral edge; forming a series of projections on said cylindrical rim of said drum body at equal circumferential spacings from each other equal to the longitudinal spacings of said perforations and at equal lateral spacings from a reference lateral edge of said rim; winding said belt circumferentially around said rim of said drum body by engaging said projections in said perforations; and securing said belt on said drum body; said perforations serving as symbol position ascertaining marks while said projections serve for correctly positioning the symbols around said rim of said drum body.

2. The method claimed in claim 1, in which said series of projections are spaced from the reference lateral edge of said rim a distance equal to the spacing of said perforations from the reference lateral edge of said belt.

3. The method claimed in claim 2, including forming said drum body with a cylindrical rim whose axial extent is substantially less than the width of said belt.

4. The method claimed in claim 3, in which said belt is translucent.

5. The method claimed in claim 2, including the step of forming said drum body with a cylindrical rim whose axial extent is equal to the width of said belt.

6. The method claimed in claim 1, in which said belt is made of a material selected from the group consisting of artificial leather, a synthetic resinous material and metal; said synthetic resinous material being selected from the group consisting of a polyester resin, a silicone resin, and an acetate resin.

7. The method claimed in claim 6, in which said belt is made of artificial leather.

8. The method claimed in claim 6, in which said belt is made of a synthetic resinous material.

9. The method claimed in claim 8, in which said synthetic resinous material is a polyester resin.

10. The method claimed in claim 8, in which said synthetic resinous material is a silicone resin.

11. The method claimed in claim 8, in which said synthetic resinous material is an acetate resin.

12. The method claimed in claim 6, in which said belt is thin sheet metal.

13. The method claimed in claim 2, in which said belt has a length slightly in excess of the external circumference of said cylinder; said belt being secured on said drum body by overlapping and bonding together the ends of said belt.

14. The method claimed in claim 2, in which the length of said belt is equal to the external circumference of said cylindrical rim; said belt being secured on said drum body with its ends in abutting relation and bonded to said cylindrical rim.

* * * * *